US006817487B2

(12) United States Patent
Ross

(10) Patent No.: US 6,817,487 B2
(45) Date of Patent: Nov. 16, 2004

(54) ROTARY LOBE PUMP METERING ASSEMBLY

(75) Inventor: Timothy P. Ross, Kannapolis, NC (US)

(73) Assignee: Rimcraft Technologies, Inc., Kannapolis, NC (US)

( * ) Notice: Subject to any disclaimer, the term of this patent is extended or adjusted under 35 U.S.C. 154(b) by 86 days.

(21) Appl. No.: 10/253,174

(22) Filed: Sep. 24, 2002

(65) Prior Publication Data

US 2004/0056047 A1 Mar. 25, 2004

(51) Int. Cl.[7] ..... B67D 5/60

(52) U.S. Cl. ..... 222/145.5; 222/367; 222/370; 222/405; 222/460

(58) Field of Search ..... 222/135, 136, 222/145.5, 145.6, 367, 370, 405, 460

(56) References Cited

U.S. PATENT DOCUMENTS

| | | | | | |
|---|---|---|---|---|---|
| 4,169,545 | A | * | 10/1979 | Decker | 222/136 |
| 4,534,493 | A | | 8/1985 | Sedran | |
| 4,632,281 | A | | 12/1986 | Wold | |
| 4,634,024 | A | * | 1/1987 | Vollenweider | 222/135 |
| 4,940,394 | A | | 7/1990 | Gibbons | |
| 5,318,415 | A | * | 6/1994 | Verhoeven | 418/46 |
| 5,567,140 | A | | 10/1996 | Dodd | |
| 5,632,413 | A | * | 5/1997 | Herring et al. | 222/1 |
| 6,095,781 | A | * | 8/2000 | Petersen et al. | 418/107 |
| 6,234,355 | B1 | * | 5/2001 | Lenhardt | 222/135 |
| 6,283,740 | B1 | * | 9/2001 | Brown | 418/206.6 |

OTHER PUBLICATIONS

Oil Systems Top Teams Trust Barnes Dry Sump oil Systems. Tri–Clover Postive Rotary Pump PR—Catalog PR86—Published by Tri–Clover, Inc. Kenosha, WI, copyright 1986.

Extrusion PUmps for High Viscosity Fluids—published by Ingersoll–Rand / ARO—copyright 2000.

Fushionmate Adhesive Dispensing System, published by ITW Plexius, copyright 1999.

GS MFG Gemini–ADH, 1:1 Ratio Structural Adhesives—copyright 1997–2000, Lincoln Industrial Corp.—http://www.lincolnindustrial.com/htmL/indust_pump_equip.asp.

GS Gemini–VR Dual Component—Variable Ratio Extrusion System.

Lobe Pumps, copyright 2002—Pump School—sponsored by Viking Pump, Inc., http://www.pumpschool.com/principles/lobe.htm.

* cited by examiner

*Primary Examiner*—Joseph A. Kaufman
(74) *Attorney, Agent, or Firm*—Robert W. Pitts

(57) ABSTRACT

A dual rotor, ram fed metering pump is especially suited for pumping high viscosity fluids, such as methacrylate resins, used in heavy duty adhesives In addition to pumping viscous materials, this metering pump also pumps a less viscous reactive fluid in proper proportion to a mixing zone or mixing gun where the two material are mixed. A rotary lobe pump is used to pump the viscous material and a rotary pump driven by the same gearbox delivers the secondary fluid. This fluid delivery apparatus also includes an intake that can be mounted on a standard pressure primmer ram to pump viscous material from a storage drum or container A single compact all-in-one metering pump package can be mounted directly to the ram eliminating the need for a separate ram mounted pump.

21 Claims, 5 Drawing Sheets

ROTARY LOBE PUMP METERING ASSEMBLY

BACKGROUND OF THE INVENTION

1. Field of the Invention

This invention is related to a pumping assembly for pumping a viscous resin or similar fluid from a storage container to a mixing head or zone where the resin will be mixed with a reactive catalyst in a suitable reactive ratio. This invention is also related to the use of rotary lobe pumps to transport viscous fluids.

2. Description of the Prior Art

Rotary lobe pumps are commonly employed in the food and food processing industries, because they are capable of transferring viscous materials. Rotary lobe pumps have also been employed in oil delivery systems in high performance automotive and racing applications. In principle, a lobe pump is similar to an external gear pump. Liquid flows into the region created as counter-rotating lobe rotors unmesh. Displacement volumes are formed between the surfaces of each lobe rotor and the pump casing Liquid is displaced by the meshing of the lobe rotors, which are not mutually engaged and are spaced apart by distances on the order of 0.002 in. Relatively large displacement volumes enable nonabrasive solid suspended in a viscous fluid to be handled Liquid velocities and shear generally remain low making the rotary lobe pumps suitable for high viscosity, shear-sensitive liquids. Two, three and four lobe rotors have been used, depending upon solids size, liquid viscosity and tolerance of the system to flow pulsation. Two lobes generally handle larger solids and high viscosities, but the two lobe configurations tend to pulsate more. Larger rotary lobe pumps can also be significantly more expensive than a centrifugal pump of equal flow and head The rotors can be fabricated from metal or rubber, with aluminum rotors being often desirable. Examples of rotary lobe pumps are shown in U.S. Pat. No. 4,940,394 and U.S. Pat. No. 5,567,140.

Rotary lobe pumps do not appear to have been used to pump viscous adhesive resins from storage containers, such a cylindrical drums, to a mixing zone or gun where the resin is mixed with a catalyst. Rotary lobe pumps also do not appear to have been used as metering pumps that mix a resin with a catalyst in a prescribed ratio, such as 10:1, suitable for reaction between the resin and catalyst. Highly viscous, heavy duty adhesives, based on methacrylate resins are widely and increasingly used, primarily in industrial applications. Commonly these viscous resins are dispensed directly from a storage or shipping container, such as a cylindrical 5 or 55 gallon drum. The resin is pumped to a metering pump where it is combined with a suitable catalyst, which tends to be less viscous, and the mixture is dispensed, normally by a mixing or dispensing gun as a bead or in a pattern suitable for a particular application. These viscous resins are difficult to pump. Prior art dispensing units typically employ a ram and a positive displacement piston pump to pump the methacrylate or other viscous resin to a second metering pump. A third pump is used to deliver the catalyst to the metering pump where the two constituent materials are joined in the proper reactive ratio.

Conventional resin dispensing units typically employ a single post ram for use with 5-gallon drums, and a two post ram for use with a 55-gallon drum A drum is secured to the ram. Typically in a two post ram, two air cylinders are joined to tie rods, which are in turn joined to a cylindrical follower plate that is inserted into the drum. A gasket or seal around the periphery of the follower plate engages the inner surface of the drum and the follower plate it forced into the drum to apply pressure on the viscous fluid in the drum. The fluid is then forced upward through an intake opening in the follower plate to a pump, such as a positive displacement piston pump, which then feeds the viscous resin through a hose to the separate metering pump. These dispensing units thus employ at least three separate conventional pumps, which are needed for use with these highly viscous, heavy-duty adhesives and resins. The dispensing units also tend to be quite expensive, which tends to limit the applications in which high performance adhesives, such a highly viscous methacrylate based adhesives, can be used. Dispensing units of this type are also used in other applications. An example of a dispensing unit of this general type is shown in U.S. Pat. No. 4,632,281. FIG. 8 shows a extrusion pump system that employs some of the basic components with which this invention is to be employed. FIG. 8 shows a two post ram 70 attached to tie rods 72 that would be in turn attached to a follower plate, not shown, inside a storage drum 80. This prior art ram applies pressure to the fluid in the drum, but a ram mounted pump 74 is needed to pump fluid from the container to an extrusion gun 76 or another application zone or device.

Unlike the prior art, the invention presented herein eliminates the need for a separate metering pump and resin pump and also employs a rotary lobe configuration in the metering pump to take advantage of the ability of rotary lobe pumps to handle highly viscous fluids.

SUMMARY OF THE INVENTION

The preferred embodiment of this invention comprises a 10:1 fixed ratio positive diaplacement metering pump for adhesive or silicone or similar applications. The ratio can be changed simply by replacing a secondary pump with a different mass flow rate. In the preferred embodiment of this invention, a dual rotary, three lobe pump is driven by a centrally located gearbox. The primary lobe pump is force fed on the adhesive or primary fluid side by mounting the pump on a pressure primer ram that applies a downward force on the fluid in a 5 or 55 gallon container. Applications for an apparatus of this type include 10:1 ratio construction adhesives, such as the methacrylate or polyester families and silicone rubbers or other 10:1 ratio material. The gearbox is driven by a C face motor that is typically pneumatically driven or can be driven by a variable speed DC, C face motor.

The pump's construction utilizes two open-ended pump cavities accessible from each end to replace both rotors and material seals. The gearbox is centrally located and sealed at both ends. The pump assemblies can be removed completely from each end and still leave the gearbox intact.

Current technology requires a ram mounted pump to feed the metering pump. The instant invention provides a single compact, all-in-one metering pump package that is mounted directly to the ram to create a much simpler, lower cost dispensing system. Such a system can also be used to feed a lower pressure sprayer.

According to this invention a metering pump used to pump a first relatively viscous fluid and a second fluid to a mixing zone includes a rotary lobe pump, which transports the first relatively viscous fluid at a first mass flow rate to the mixing zone. An auxiliary rotary pump transports the second fluid at a fixed ratio, relative to the mass flow rate of the first relatively viscous fluid, to the mixing zone so that the two fluids enter the mixing zone to react in a proper ratio. Drive means, which can be a common gearbox, drives the rotary lobe pump and the auxiliary rotary pump.

DETAILED DESCRIPTION OF THE PREFERRED EMBODIMENT

Figure 1:
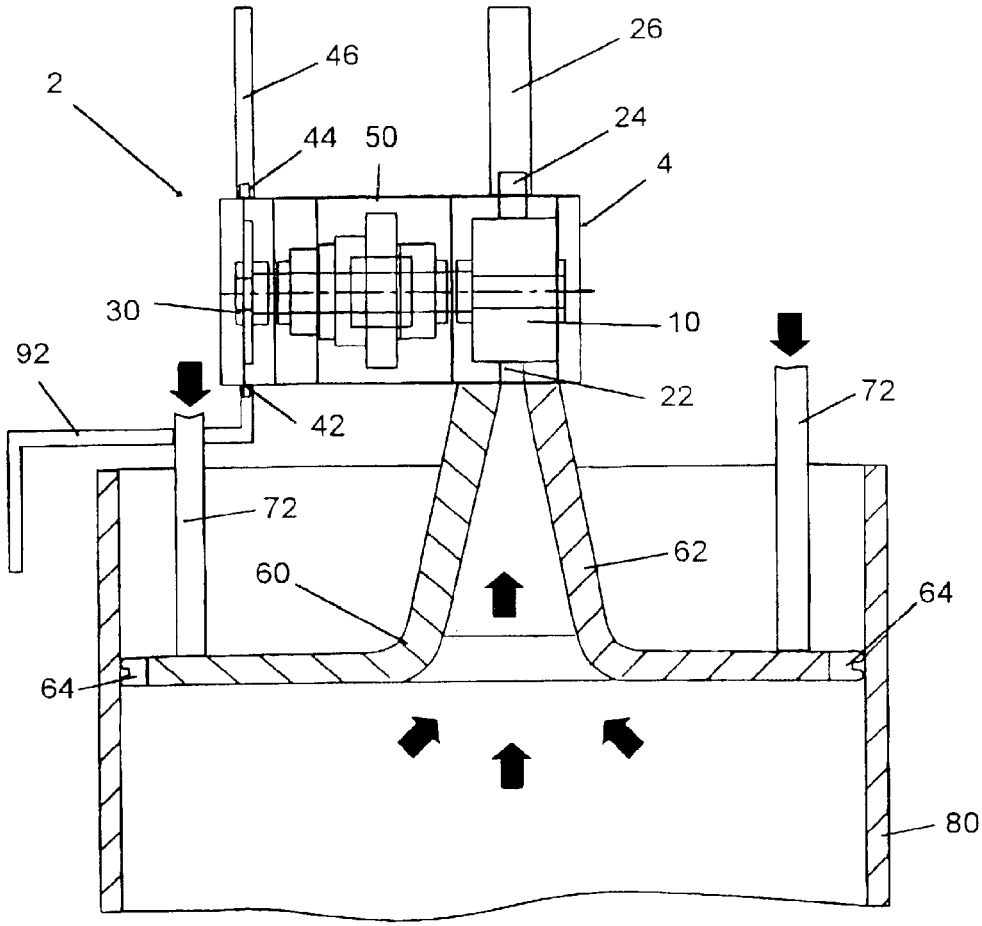
FIG. 1 is a schematic view showing components of the rotary lobe pump metering assembly and the manner in which that pumping assembly would be used to deliver a viscous resin, directly from a storage drum, and a catalyst to a mixing zone, such as a mixing gun.

FIG. 1 shows a fluid delivery apparatus 2 for use in dispensing and metering a viscous resin, such as a methacrylate resin, and a reactive catalyst in proper proportion to a mixing zone or mixing gun where these constituent materials form a high performance adhesive. These materials are commonly mixed in a 10:1 ratio. Other multiple component materials, such as polyester based construction adhesives and silicone rubbers, also are mixed on a 10:1 ratio. The same dispensing and metering fluid delivery apparatus 2 can therefore be used in applications other than the methacrylate based construction adhesive compositions for which it is particularly appropriate.

The dispensing and metering fluid delivery apparatus 2 includes a metering pump subassembly 4 and an intake subassembly 60, which can be attached to a conventional ram 70 with the use of adapter plates for the specific ram that will be employed. The configuration of specific adapter plates are governed by the particular conventional ram that would be employed with the dispensing and metering apparatus 2 and the configuration of the individual adapter plates is not critical to the operation of the apparatus 2, and therefore is not shown herein.

The intake subassembly 60 is mounted in a storage drum 80 containing the viscous material to be pumped. The metering pump subassembly 4 is mounted on the intake 60. The ram 70 then applies pressure to the viscous material in the drum 80, and this material is fed through the intake 60 to the metering pump subassembly 4, which then pumps the primary material from the drum 80 to a mixing zone or gun 100. The catalyst is also pumped through the metering pump subassembly 4 in the proper portion from a separate source or container to the same mixing zone or gun 100. Both the resin and the catalyst are then pumped by the metering pump assembly 4, eliminating the need for a separate pump as part of the dispensing unit.

The metering pump assembly 4 comprising a primary rotary lobe pump 10 and an auxiliary rotary pump 30, which pumps a fluid of lesser viscosity and at a smaller mass flow rate than the primary rotary lobe pump 10. The auxiliary rotary pump 30 can be either an auxiliary rotary lobe pump or and auxiliary rotary gear pump. Both rotary pumps 10 and 30 are driven by the same drive means 50, which in the preferred embodiment is a 30:1 ratio gearbox. The main and auxiliary rotary pumps are located on opposite sides of the gearbox 50. The metering pump assembly 4 is mounted directly to the intake 60 with the primary rotary lobe pump 10 in communication with the intake 60. The auxiliary rotary pump 30, while attached to the gearbox 50 and the primary rotary lobe pump 10 communicates with a source of catalyst through a delivery hose extending between a catalyst container 90 and the auxiliary input port 42. The resin is then delivered from the primary rotary lobe pump 10 to the mixing zone or gun 100 through a hose 26. The catalyst is delivered from the auxiliary rotary lobe pump 30 to the mixing zone or gun 100 through an auxiliary output hose 46.

Pressure is relied upon to deliver both the resin to the primary lobe pump 10 and the catalyst or less viscous fluid to the auxiliary rotary pump 30. The ram 70 applies the pressure to the more viscous resin to force the resin into the intake 60. The less viscous fluid can be supplied to the auxiliary rotary pump by applying air pressure to the container 90 forming the reservoir for the catalyst or less viscous material.

Figure 4:
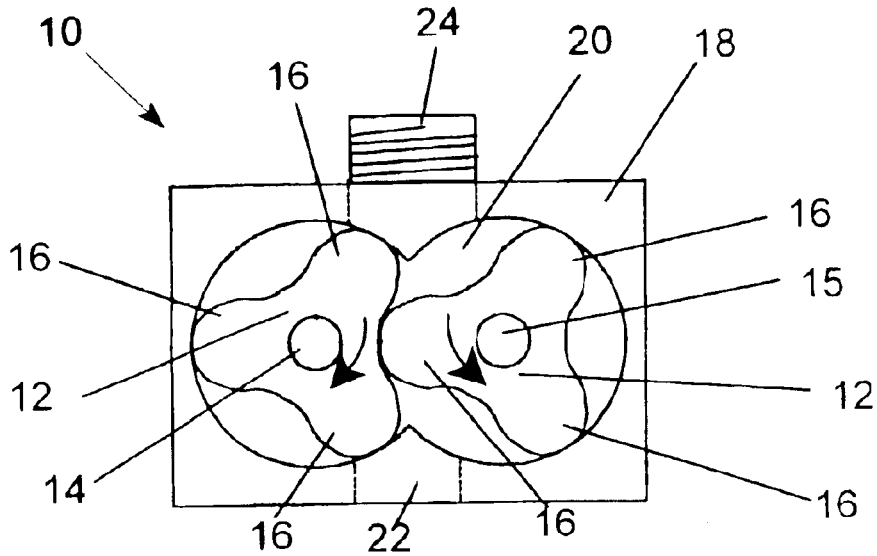
FIG. 4 is a view of the rotors and pumping chamber in the primary lobe pump.

The primary rotary lobe pump 10 includes a pair of lobe rotors 12 mounted on separate parallel shafts 14, 15. In the preferred embodiment, each lobe rotor 12 has three lobes 16, which are mounted in a casing 18 that forms a pump chamber 20 in which the rotors are located An input port 22 supplies fluid to the pump chamber 20 and an output port delivers the pumped fluid through the output hose 26 to the mixing zone 100. One of the rotors 12 is driven by the gearbox 50 to rotate in a clockwise direction and the other rotor 12 is driven in the counterclockwise direction as shown in FIG. 4. The rotors 12 are spaced apart by a distance of approximately 0.002 in. As the lobe rotors 12 rotate, the viscous primary fluid is transported through the pump chamber between the lobes 16 and the inner surface of the casing 18. Material having a viscosity in excess of 500,000 centipoise can be transported through the primary lobe pump 10 in this manner.

Figure 2:
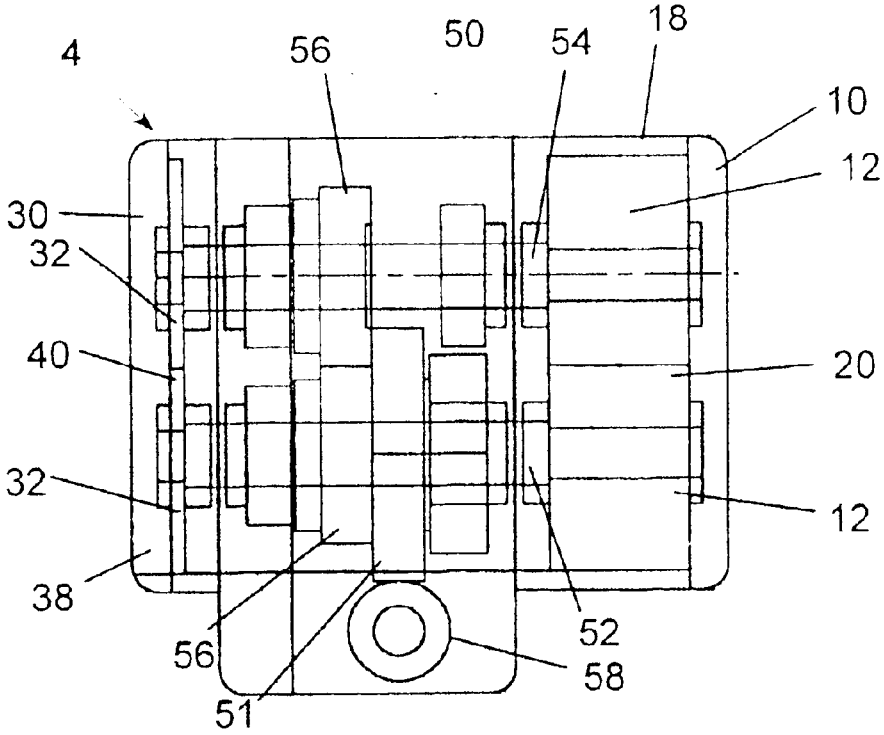
FIG. 2 is a top view of the metering pump subassembly.

Both the primary rotary lobe pump 10 and the auxiliary lobe pump 30 are driven by a 30:1 gearbox 50. In the preferred embodiment as best seen in Figure, power is delivered to the gearbox 50 through a NEMA 56C drive input 58. Typically the metering pump subassembly 4 would be pneumatically driven, although an electric motor could be employed to power the two rotary pumps 10 and 30. As best seen in FIG. 2, a worm gear 51 is driven by the input 58 and timing gears 56 are in turn driven in opposite directions. First and second shafts 52 and 54 are then caused to rotate in opposite directions. These shafts are each attached to one rotor in each of the rotary pumps 10 and 30, driving the two primary lobe rotors 12 and the auxiliary lobe rotors 36, or gears, in opposite directions. Both the primary rotary lobe pump 10 and the auxiliary rotary pump 30 are bolted or otherwise attached on opposite sides of the gearbox 50 and seals, not shown, are located at the interface of each of the three components of the metering pump subassembly 4. This pump subassembly 4 can be mounted directly to the intake 60 to deliver a viscous fluid from a drum 80, in which the intake 60 is placed, to the pumping chamber of the primary rotary lobe pump 10 In the preferred embodiment, the pump subassembly 4 is bolted directly to the intake 60, although the two components can be attached in other ways.

Figure 3:
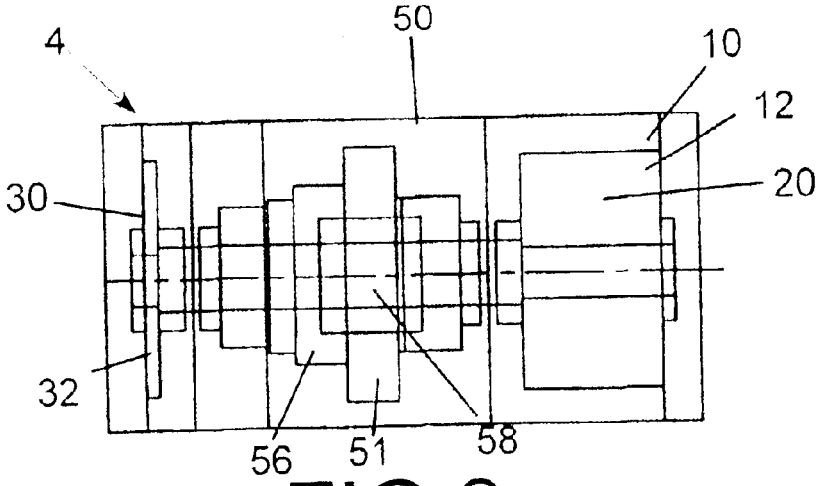
FIG. 3 is a front view of the metering pump subassembly shown in FIG. 2.

FIG. 3 shows the position of the two lobe rotors 12 in the pumping chamber 20 formed in the primary rotary lobe casing 18. Each of the rotors 12 has three lobes 16 in the preferred embodiment, although other lobe configurations could be suitable for certain applications. The lobe rotors 12 are mounted on parallel shafts 14, 15 that rotate in opposite directions when driven by the gearbox 50. The pump chamber 20 is formed by semi-cylindrical walls that merge in the center where the lobes 16 mesh as they rotate. All or substantially all of the viscous fluid entering under pressure into the pump chamber 20 through input port 24 is pumped generally around the outside of the pump chamber by rotary movement of the lobes 16. This primary rotary lobe pump 10 thus transfers the viscous fluid or resin from the input port 22 to the output port 24 in a conventional manner. The viscous fluid is then transferred at a prescribed mass flow rate through the output hose 26 to the mixing zone or gun 100.

Figure 5:
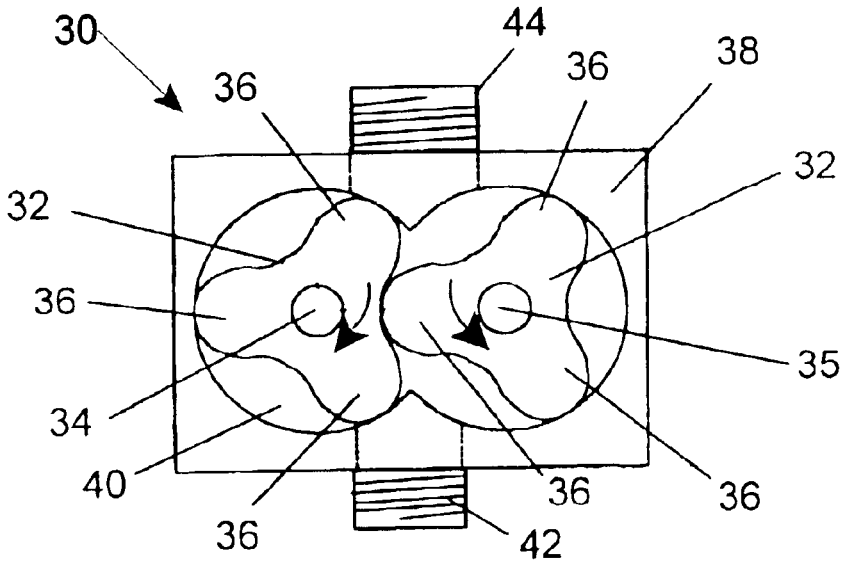
FIG. 5 is a view of auxiliary rotors in an auxiliary pumping chamber for an auxiliary lobe pump.

An auxiliary lobe pump 30 would operate in the same manner to transfer the secondary fluid, such as a catalyst reactive with the resin, from a catalyst container 90, pressurized through input 94 to a catalyst delivery hose 92, which transfers the catalyst or other secondary fluid to the mixing zone or gun 100. FIG. 5 shows an auxiliary rotary lobe pump 30, which includes auxiliary rotors 32 rotating in opposite directions on shafts 34, 35. The auxiliary rotors 32 each have three lobes 36, and they are mounted in an auxiliary pump chamber 40 within casing 38. The auxiliary pump chamber 40 is fed by auxiliary input port 42 and the secondary fluid flows from the pump chamber 40 to an auxiliary fluid delivery hose 46 through output port 44. In the preferred embodiment, hose fittings are used on each port 42, 44, since the secondary fluid traverses a different path to mixing zone 100 than that of the primary fluid pumped by rotary lobe pump 10.

The mass flow rate through the primary rotary lobe pump 10 differs from the mass from the mass flow rate of the auxiliary rotary pump 30, even though both rotary pumps rotate at the same speed. The ratio of the two mass flow rates does however remain constant. This constant ratio is achieved because the depth of the primary pumping chamber 20 is greater than the depth of the auxiliary pumping chamber 40. Correspondingly, the thickness of the primary lobe rotors 12 is greater than the depth of the auxiliary lobe rotors 32, as can be seen in FIGS. 2 and 3. Thus the volume or mass of fluid that can be pumped through the two chambers is directly related to the size of the lobes 12 and 32 and the pumping chambers 20 and 40. In the preferred embodiment this thickness of the primary rotors 12 is ten times the thickness of the auxiliary rotors 32, so that the mass flow rate of the primary fluid is ten times the mass flow rate of the auxiliary fluid Pump subassembly therefore comprises a constant 10:1 metering pump in addition to being the main pump for transporting both fluids to the mixing zone or gun 100. This 10:1 ratio is the ratio in which methacrylate resins should be mixed in proportion to a reactive catalyst, as well as the ratio in which a number of two component reactive systems, such as polyester based construction adhesives and silicone rubbers, should be mixed. Thus this 10:1 metering pump is suitable for a wide variety of uses.

Figure 6:
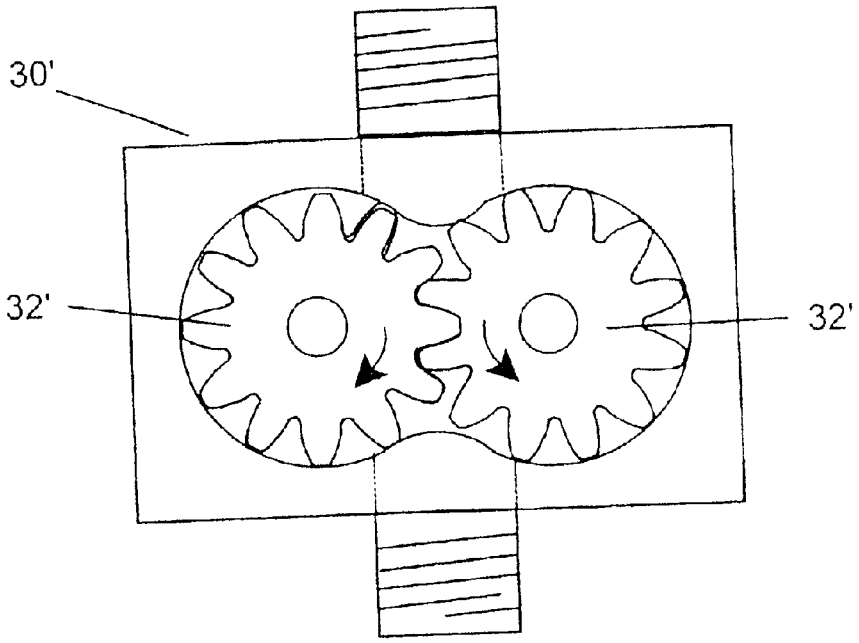
FIG. 6 is a view of an auxiliary gear pump, which can be employed in an alternate embodiment of the fluid delivery system.

FIG. 6 shows an auxiliary gear pump 30' that can be used in substantially the same manner as the auxiliary lobe pump 30. The auxiliary gear pump 30' employs gears 32' instead of lobes, but otherwise functions in substantially the same manner.

Figure 8:
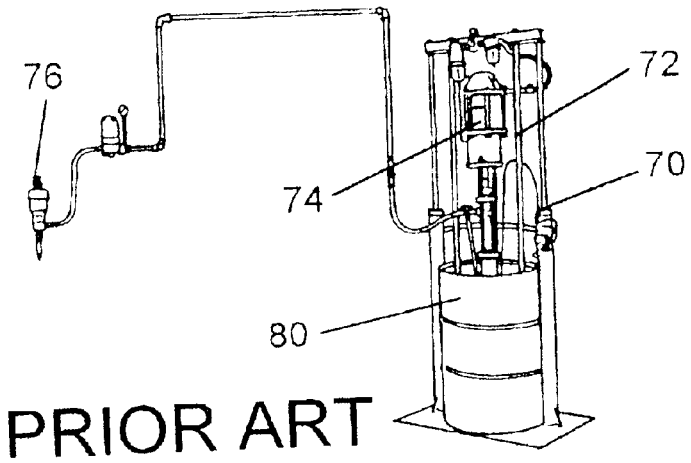
FIG. 8 is a view of a prior art extrusion application which employs some of the same components as this system.

A ram and intake assembly is used to deliver the primary viscous fluid from a drum 80 under pressure to the primary rotary lobe pump 10. The ram is conventional and a ram, such as the prior art two post ram 70, shown in FIG. 8, or a single post ram can be used in combination with the intake 60. Intake 60, as shown in FIG. 1, comprises a cylindrical member that will fit within a corresponding cylindrical container or standard drum in which fluid materials are shipped and stored. Of course an intake used for a 55 gallon drum would be correspondingly larger than an intake used with a 5 gallon drum. A gasket 64 surrounds the intake 60 in the same manner as for an intake or follower plate used in a conventional dispensing system for delivering highly viscous or heavy-duty adhesives. A funnel 62, having the shape of a frustum of a cone, extends upwardly from the center of the intake 60. In the preferred embodiment, the intake angle of the funnel is between fifteen and twenty degrees relative to the vertical. The funnel 62 is open at the top and bottom. The top of the funnel can be attached to the metering pump assembly with the funnel 62 in alignment with the input port 22 of the primary rotary lobe pump 10. Tie rods 72 connect the intake to the ram 70 and a downward force transferred through the tie rods 72 to the intake 60 applies pressure on the viscous fluid in the container 80, forcing that viscous fluid up through the funnel into the primary rotary lobe pump 10.

Figure 7:
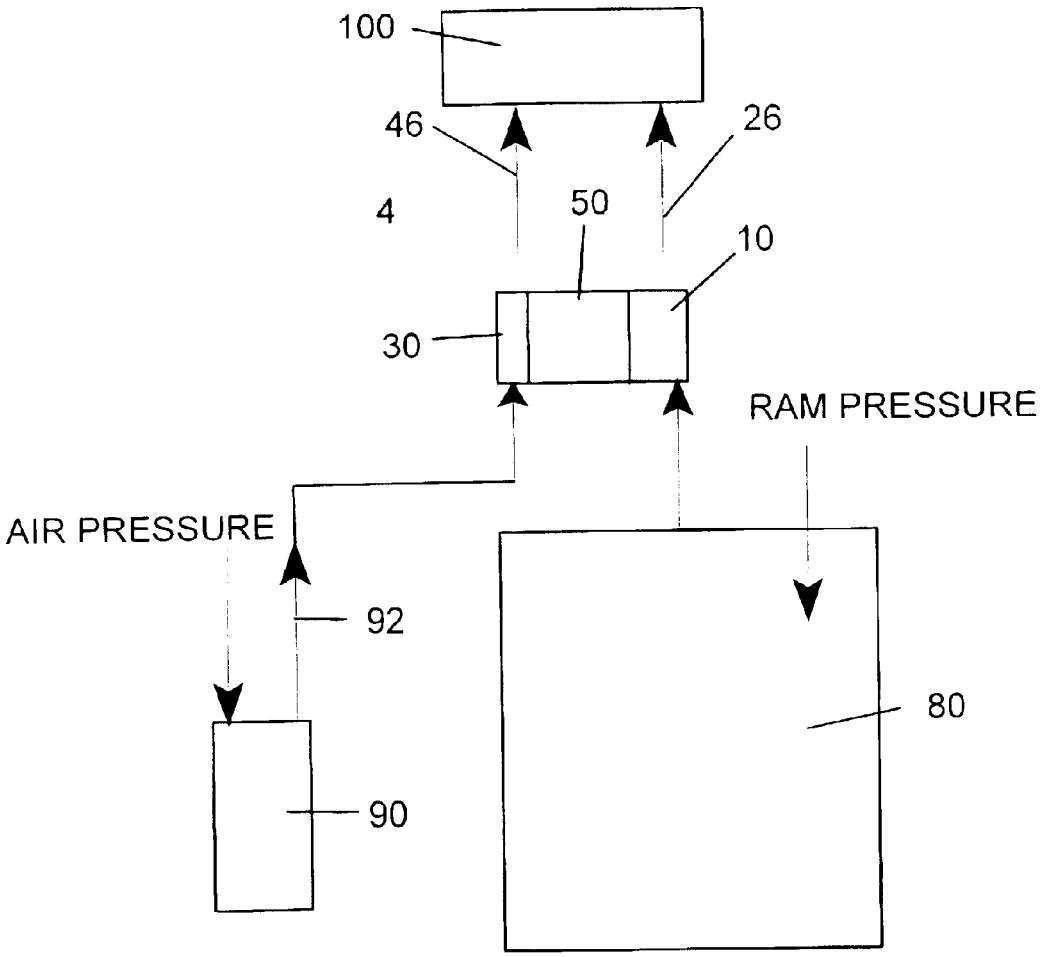
FIG. 7 is a schematic showing the relationship of important components of this system.

The catalyst or secondary fluid is also delivered to the pump assembly under pressure as shown schematically in FIG. 7. A simple approach would be to employ a two gallon pressure tank 90 with a pressure input 92 connected to source of air pressure. The lower viscosity catalyst or secondary fluid can then be delivered through hose 92 to the auxiliary pump 30.

The representative embodiment described herein is the preferred manner of implementing this invention. It should be understood, however, that numerous modifications could be made by one skilled in the art without departing from the subject matter set forth in the following claims.

I claim:

1. A metering pump for use in pumping a first relatively viscous fluid and a second fluid to a mixing zone, the metering pump comprising:

a rotary lobe pump comprising means for transporting the first relatively viscous fluid at a first mass flow rate to the mixing zone:

an auxiliary rotary pump comprising means for transporting the second fluid at a fixed ratio, relative to the mass flow rate of the first relatively viscous fluid, to the mixing zone so that the two fluids enter the mixing zone to react in a proper ratio, wherein the auxiliary rotary pump comprises a gear pump and drive means for driving the rotary lobe pump and the auxiliary rotary pump.

2. The metering pump of claim 1 wherein the drive means comprises a gear box.

3. The metering pump of claim 2 wherein the gear box is located between the rotary lobe pump and the auxiliary rotary pump.

4. The metering pump of claim 1 wherein the rotary lobe pump and the auxiliary rotary pump rotate at the same speed, the ratio of mass flow rate of the first relatively viscous fluid relative to the mass flow rate of the second fluid being dependent upon the thickness of the rotary lobe in the rotary lobe pump to the thickness of rotary members in the auxiliary rotary pump.

5. The metering pump of claim 1 wherein the rotary lobe pump comprises means for pumping a methacrylate adhesive resin in a 10:1 ratio relative to a catalyst pumped to the mixing zone by the auxiliary rotary pump to react to the methacrylate resin in the mixing zone.

6. The metering pump of claim 1 wherein the rotary lobe pump includes two rotors rotating on parallel shafts, each rotor being separately driven by the drive means.

7. An apparatus for transporting a viscous fluid directly from a shipping container to a mixing zone where the viscous fluid will react with a second fluid delivered to the mixing zone at a specified proportional rate relative to the flow rate of the viscous fluid, the apparatus comprising:

a rotary lobe pump:

an intake mountable in the container, the rotary lobe pump being mounted on the intake, the intake comprising means for delivering fluid under pressure to the rotary lobe pump, wherein the intake comprises a funnel.

8. The apparatus of claim 7 wherein the rotary lobe pump includes an inlet fitting attachable to the intake.

9. The apparatus of claim 7 wherein the intake is mountable on a cylindrical drum in which the viscous fluid can be shipped.

10. The apparatus of claim 7 further comprising an auxiliary rotary pump for delivering the second fluid from a separate container, the auxiliary rotary pump and the rotary lobe pump being attached to a common drive means.

11. The apparatus of claim 10 wherein the rotary lobe pump and the auxiliary rotary pump are attached to a gearbox comprising the drive means to form a pumping subassembly, the pumping subassembly being mounted on the intake.

12. An assembly for dispensing a viscous resin and a catalyst to a mixing zone wherein the viscous resin and the catalyst react, the assembly comprising:

a rotary lobe pump comprising means for pumping the viscous resin;

an auxiliary rotary pump comprising means for pumping the catalyst;

an intake mountable in a cylindrical container comprising means for delivering viscous fluid under pressure in the container to the rotary lobe pump;

a ram comprising means for applying pressure to the viscous fluid; and means for delivering catalyst under pressure to the auxiliary rotary pump.

13. The assembly of claim 12 comprising drive means for driving both the rotary lobe pump and the auxiliary rotary pump.

14. The assembly of claim 13 wherein the drive means comprises a gearbox, the rotary lobe pump and the auxiliary rotary pump being mounted on the gearbox.

15. The assembly of claim 12 wherein the auxiliary rotary pump comprises an auxiliary rotary lobe pump having a mass flow rate that is less than the mass flow rate of the rotary lobe pump, the ratio of the mass flow rate through the rotary lobe pump to the mass flow rate through the auxiliary lobe pump being constant and equal to a desired reactive ration for the resin and the catalyst.

16. The assembly of claim 12 wherein the rotary lobe pump comprises means for pumping a viscous methacrylate adhesive resin.

17. The assembly of claim 12 wherein the rotary lobe pump and the auxiliary rotary pump comprise a metering pump assembly suitable for establishing a proportional mass flow rate for the viscous resin and the catalyst.

18. An assembly for dispensing a viscous resin and a catalyst to a mixing zone wherein the viscous resin and the catalyst react, the assembly comprising:

a primary metering pump comprising means for pumping the viscous resin;

an auxiliary metering pump comprising means for pumping the catalyst;

an intake mountable in a cylindrical container comprising means for delivering viscous fluid under pressure in the container to the primary metering pump;

a ram comprising means for applying pressure to the viscous fluid; and means for delivering catalyst under pressure to the auxiliary metering pump.

19. The assembly of claim 18 wherein the primary metering pump comprises a rotary lobe pump.

20. The assembly of claim 18 wherein the auxiliary metering pump comprises a rotary pump.

21. The assembly of claim 18 wherein the intake comprises a funnel.

* * * * *